US009966653B2

(12) United States Patent
McAuliffe et al.

(10) Patent No.: US 9,966,653 B2
(45) Date of Patent: May 8, 2018

(54) ANTENNAS FOR ELECTRONIC DEVICE WITH HEAT SPREADER

(71) Applicant: Apple Inc., Cupertino, CA (US)

(72) Inventors: Erin A. McAuliffe, Campbell, CA (US); James W. Jervis, Santa Clara, CA (US); Andrea Ruaro, Copenhagen (DK); Mattia Pascolini, San Francisco, CA (US); Jerzy S. Guterman, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 175 days.

(21) Appl. No.: 14/839,619

(22) Filed: Aug. 28, 2015

(65) Prior Publication Data

US 2017/0062906 A1 Mar. 2, 2017

(51) Int. Cl.

| | |
|---|---|
| ***H01Q 1/24*** | (2006.01) |
| ***H01Q 9/42*** | (2006.01) |
| ***H01Q 5/371*** | (2015.01) |
| ***H01Q 1/06*** | (2006.01) |
| ***H01Q 1/38*** | (2006.01) |
| ***H01Q 9/04*** | (2006.01) |

(52) U.S. Cl.
CPC ..... *H01Q 1/24* (2013.01); *H01Q 1/06* (2013.01); *H01Q 1/243* (2013.01); *H01Q 1/38* (2013.01); *H01Q 5/371* (2015.01); *H01Q 9/04* (2013.01); *H01Q 9/42* (2013.01)

(58) Field of Classification Search
None
See application file for complete search history.

(56) References Cited

U.S. PATENT DOCUMENTS

| | | | | |
|---|---|---|---|---|
| 6,392,600 | B1 | 5/2002 | Carson et al. | |
| 8,228,239 | B2 | 7/2012 | Lagnado et al. | |
| 8,256,685 | B2 | 9/2012 | Chen et al. | |
| 8,482,118 | B2 | 7/2013 | Mohan et al. | |
| 8,599,089 | B2 | 12/2013 | Bevelacqua et al. | |
| 2003/0122724 | A1* | 7/2003 | Shelley | H01Q 1/525 343/786 |

(Continued)

FOREIGN PATENT DOCUMENTS

| | | |
|---|---|---|
| AU | 2015100917 | 8/2015 |
| CN | 1885847 A | 12/2006 |

(Continued)

*Primary Examiner* — Trinh Dinh
(74) *Attorney, Agent, or Firm* — Treyz Law Group, P.C.; G. Victor Treyz; Tianyi He

(57) ABSTRACT

An electronic device may have wireless circuitry with antennas. The electronic device may have a dielectric housing. A printed circuit board with electrical components may be mounted in the dielectric housing. Heat spreader structures may be used to dissipate heat from the electrical components. The heat spreader structures be configured to form antenna cavities. The antennas in the electronic device may be formed from the antenna cavities and may have antenna resonating elements formed on the printed circuit. An electrical component such as a light-emitting diode may be mounted in one of the antenna cavities. Each antenna element may be an inverted-F antenna resonating element with short and long arms. The short arm of each antenna resonating element may be formed from edge plated metal traces on an edge of the printed circuit.

19 Claims, 9 Drawing Sheets

(56) References Cited

U.S. PATENT DOCUMENTS

| | | | | |
|---|---|---|---|---|
| 2004/0140429 | A1* | 7/2004 | Jack | G01J 5/08 250/338.1 |
| 2009/0153412 | A1 | 6/2009 | Chiang et al. | |
| 2011/0006953 | A1 | 1/2011 | Chiang et al. | |
| 2011/0050509 | A1 | 3/2011 | Ayala Vazquez et al. | |
| 2012/0176278 | A1* | 7/2012 | Merz | H01Q 1/243 343/702 |
| 2013/0050032 | A1 | 2/2013 | Shiu et al. | |
| 2013/0088397 | A1* | 4/2013 | Mo | H01Q 1/243 343/702 |
| 2014/0240195 | A1* | 8/2014 | Shiu | H01Q 1/24 343/893 |
| 2014/0266922 | A1* | 9/2014 | Jin | H01Q 21/28 343/702 |
| 2014/0361931 | A1 | 12/2014 | Irci et al. | |
| 2015/0042528 | A1 | 2/2015 | Jung | |
| 2015/0288053 | A1* | 10/2015 | Saxe | H01Q 1/243 343/702 |
| 2016/0028148 | A1* | 1/2016 | Tan | H01Q 1/48 343/702 |
| 2016/0204499 | A1* | 7/2016 | Toh | H01Q 1/24 343/702 |

FOREIGN PATENT DOCUMENTS

| | | | |
|---|---|---|---|
| CN | 201629397 | U | 11/2010 |
| CN | 202917625 | U | 5/2013 |
| CN | 104126248 | A | 10/2014 |
| WO | 1996038878 | | 6/1996 |
| WO | 2013093563 | A1 | 6/2013 |

* cited by examiner

ANTENNAS FOR ELECTRONIC DEVICE WITH HEAT SPREADER

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of electrical components and conductive structures in the device can influence antenna performance. Antenna performance may not be satisfactory if conductive structures and electrical components in a device are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices.

SUMMARY

An electronic device may have wireless circuitry with antennas. The electronic device may have a dielectric housing. A printed circuit board with electrical components may be mounted in the dielectric housing. Heat spreader structures that are used to dissipate heat from the electrical components may also be mounted in the housing.

The heat spreader structures may include a metal heat spreader from which corner portions have been removed to form antenna cavities. The antennas in the electronic device may each be formed from an antenna resonating element and one of the antenna cavities. Antennas may be located at the corners of the electronic device housing. The antennas may handle wireless local area network signals or other wireless signals.

An electrical component such as a light-emitting diode may be mounted in one of the antenna cavities. Each antenna may have an inverted-F antenna resonating element with short and long arms to support dual band operation. The short arm of each antenna resonating element may be formed from edge plated metal traces on an edge of the printed circuit. The long arm may lie between a rear wall of the antenna cavity and the short arm.

DETAILED DESCRIPTION

Figure 1:
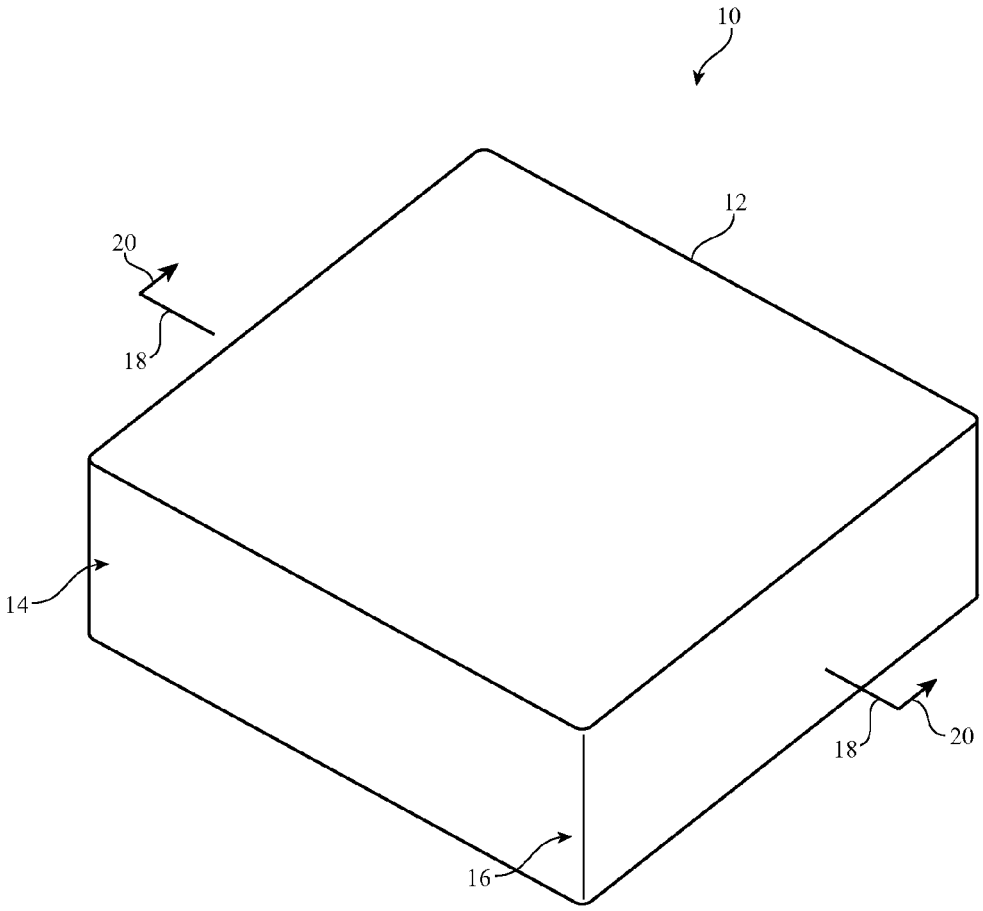
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in one or more wireless communications bands.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment. As an example, device 10 may be a set-top box or computer that has a rectangular or square housing and that is coupled to a computer monitor, television, or other display.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. Parts of housing 12 (e.g., an outer housing shell) may be formed from walls of dielectric or other low-conductivity material. Housing 12 or other structures in device 10 (e.g., heat sink structures, internal housing structures, etc.) may also be formed from metal. The footprint of device 10 (i.e., the shape of housing 12 when viewed from above) may be rectangular, square, or other suitable shape. The shape of housing 12 may be cubic, rectangular box-shaped, or may have other suitable shapes.

To handle wireless communications, device 10 may contain one or more antennas. The antennas can include loop antennas, inverted-F antennas, strip antennas, planar inverted-F antennas, slot antennas, hybrid antennas that include antenna structures of more than one type, or other suitable antennas.

In general, device 10 may include any suitable number of antennas (e.g., one or more, two or more, three or more, four or more, etc.). The antennas in device 10 may be located at the corners of housing 12 (see, e.g., corners 14 and 16), may be located along one or more edges of a device housing, may be formed in the center of housing 12, or may be located in other suitable locations.

Figure 2:
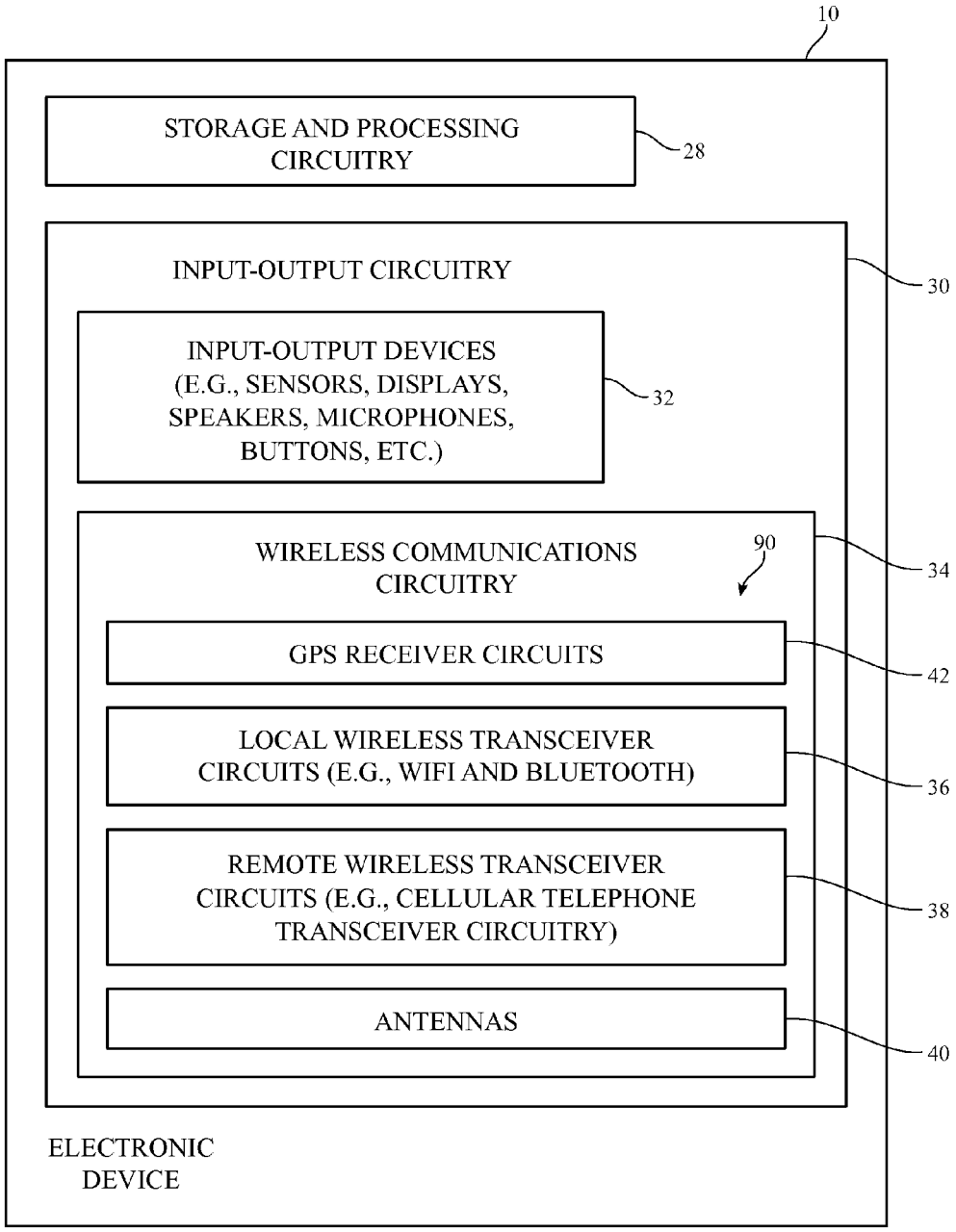
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network circuitry that handles 2.4 GHz and 5 GHz bands for WiFi® (IEEE 802.11) communications and that handles the 2.4 GHz Bluetooth® communications band. If desired, wireless communications circuitry 34 may also include additional transceiver such as cellular telephone transceiver circuitry or other remote wireless circuitry 38 and satellite navigation system circuitry such as Global Positioning System (GPS) circuitry 42. Wireless communications circuitry 34 can also include 60 GHz transceiver circuitry or other extremely high frequency communications circuitry, circuitry for receiving television and radio signals, paging system transceivers, near field communications (NFC) circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. Antennas 40 may be single band antennas, dual band antennas, or antennas that resonate in more than three communications bands. As an example, antennas 40 may handle wireless local area network communications in a single communications band such as a communications band at 2.4 GHz or may handle communications in multiple bands (e.g., a 2.4 GHz band and a 5 GHz band).

Figure 3:
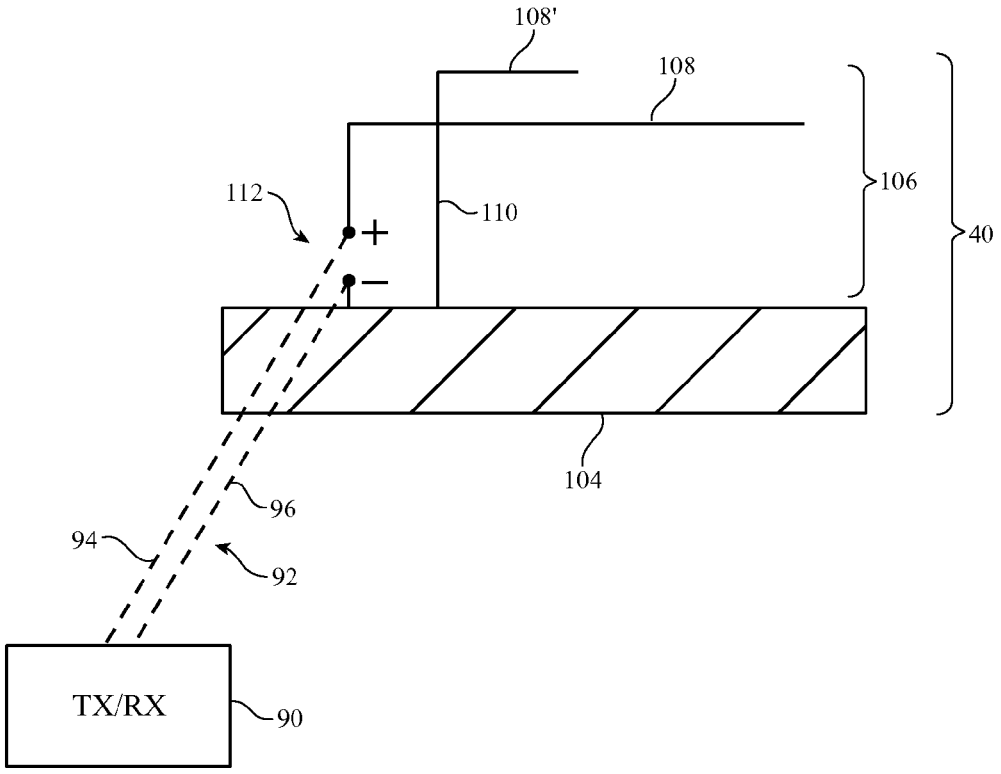
FIG. 3 is a diagram of an illustrative antenna for an electronic device in accordance with an embodiment.

An illustrative antenna for device 10 that is coupled to a transceiver circuit is shown in FIG. 3. Antenna 40 of FIG. 3 is an inverted-F antenna having inverted-F antenna resonating element 106 and antenna ground 104. As shown in FIG. 3, transceiver circuitry 90 may be coupled to antenna structures 40 using paths such as transmission line path 92. Transceiver circuitry 90 may be coupled to control circuitry 28. Control circuitry 28 may use transceiver circuitry 90 to transmit and receive wireless data through antenna 40.

Transmission line path 92 of FIG. 3 may have a positive signal conductor such as line 94 and a ground signal conductor such as line 96. Lines 94 and 96 may form parts of a coaxial cable, a stripline transmission line, or a microstrip transmission line (as examples). A matching network formed from components such as inductors, resistors, and capacitors may be used in matching the impedance of antenna 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry and tunable components in antenna 40 and may include tunable and/or fixed devices.

Transmission line 92 may be coupled to antenna feed structures associated with antenna 40 such as feed 112. Inverted-F antenna 40 of FIG. 3 has antenna resonating element 106 and antenna ground 104. Antenna resonating element 106 may have a main resonating element arm such as arm 108 and a secondary arm (e.g., a shorter arm) such as arm 108'. The lengths of arms 108 and 108' may be selected so that antenna 40 resonates at desired operating frequencies. For example, the lengths of arms 108 and 108' may be a quarter of a wavelength at desired operating frequencies for antenna 40. Antenna 40 may also exhibit resonances at harmonic frequencies.

Main resonating element arm 108 may be coupled to ground 104 by return path 110. An inductor or other component may be interposed in path 110 and/or tunable components may be interposed in path 110 and/or coupled in parallel with path 110 between arm 108 and ground 104.

Antenna feed 112 may include positive antenna feed terminal 98 and ground antenna feed terminal 100 and may run in parallel to return path 110 between resonating element 106 and ground 104. If desired, inverted-F antennas such as illustrative antenna 40 of FIG. 4 may have more than one resonating arm (e.g., multiple arms such as arm 108 and 108') to create multiple frequency resonances to support operations in multiple communications bands) or may have other antenna structures (e.g., parasitic antenna resonating elements, tunable components to support antenna tuning, etc.). Multiple feeds may be used to feed antennas such as antenna 40.

In the example of FIG. 3, antenna 40 is an inverted-F antenna having main arm 108 for supporting communications at a first communications band such as a 2.4 GHz communications band and secondary arm 108' for supporting communications at a second communications band such as a 5.0 GHz communications band (i.e., antenna 40 may be a wireless local area network antenna such as a dual band WiFi® antenna). Other configurations may be used for antenna 40, if desired. The configuration of FIG. 3 is merely illustrative.

Antenna 40 may be formed from metal traces on a printed circuit board and other conductive structures in device 10. With one suitable arrangement, which may sometimes be described herein as an example, resonating element 106 may be formed from patterned metal traces on a printed circuit board, whereas ground 104 may be formed from a metal antenna cavity structure that is shorted to ground traces on the printed circuit board. The metal cavity structure may, as an example, be formed from a cavity in a metal device structure such as a metal heat spreader (e.g., a heat sink).

Figure 4:
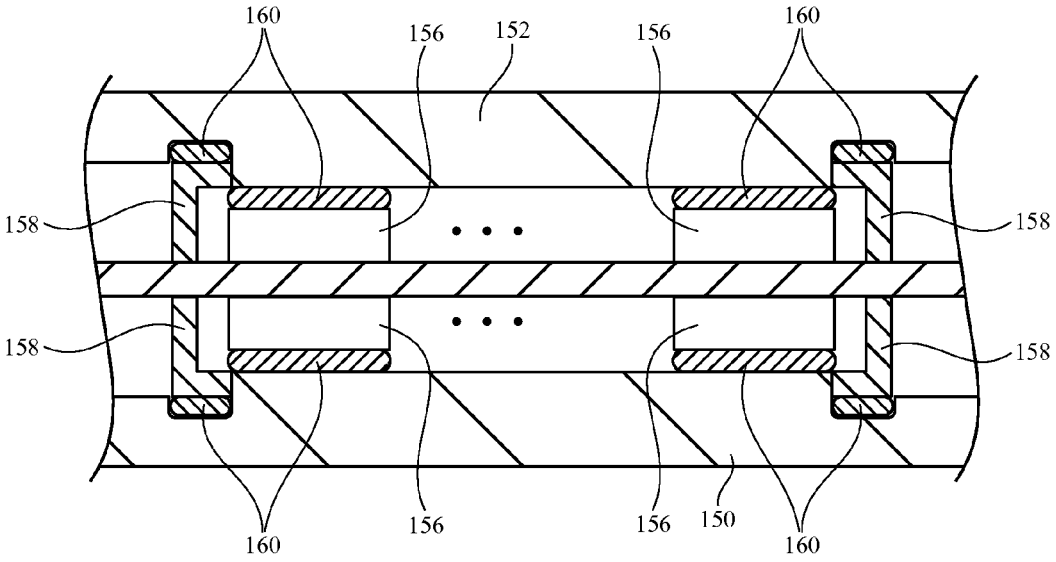
FIG. 4 is a cross-sectional side view of an illustrative printed circuit board and associated heat spreaders in accordance with an embodiment.

A cross-sectional side view of an illustrative printed circuit and associated heat spreader (thermal spreader) structures of the type that may be used in device 10 is shown in FIG. 4. As shown in FIG. 4, electrical components 156 for device 10 may be mounted on one or both sides of printed circuit 154. Printed circuit 154 may contain patterned metal traces to which contacts on electrical components 156 are coupled using solder or other conductive material. Components 156 may include integrated circuits, sensors, and other circuitry for device 10 (see, e.g., storage and processing circuitry 28 and input-output circuitry 30 of FIG. 2). Heat spreaders 152 and 150 (sometimes referred to as heat sinks, heat sink structures, or thermal spreaders) may be used to dissipate heat that is generated by components 156 during operation. Heat spreaders 152 and 150 may be formed from copper, aluminum, zinc, iron, other metals, or other materials that conduct heat effectively. Heat spreaders 152 and 150 may have shapes that help device 10 release heat through housing 12 into the air surrounding device. Mounting structures such as support structures 158 and thermal compound or other material 160 (e.g., gasket material, adhesive, solder, etc.) may be used in mounting heat spreaders 150 and 152 to printed circuit 154. In the illustrative configuration of FIG. 4, a first heat spreader (heat spreader 152) is mounted above components 156 on the upper surface of printed circuit 154 and a second heat spreader (heat spreader 150) is mounted below components 156 on the opposing lower surface of printed circuit 154.

Figure 5:
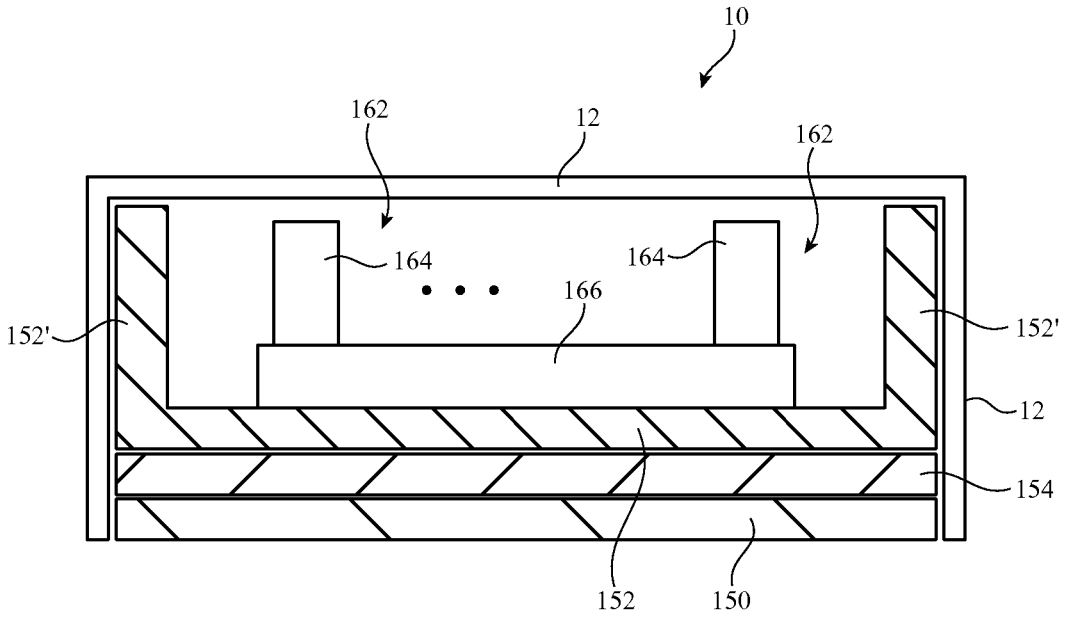
FIG. 5 is a cross-sectional side view of an illustrative electronic device in accordance with an embodiment of the present invention.

FIG. 5 is a cross-sectional side view of device 10 of FIG. 1 taken along line 18 and viewed in direction 20. As shown in FIG. 5, device 10 may include printed circuit 154 and heat spreaders 152 and 150 in housing 12. Housing 12 may be formed from a dielectric structure such as a plastic shell or other suitable structure that forms the exterior surfaces of device 10 (e.g., the top wall and side walls of device 10). Heat spreader 150 or a structure on which heat spreader 150 is mounted may form the lower surface of the housing for device 10. Upper heat spreader 152 may have vertically extending portions 152' that help dissipate heat through housing 12. Circuitry 162 may include components 164 (e.g., power supply capacitors, etc.) and other circuitry 166. Circuitry 162 may include, for example, a power supply that converts alternating current (AC) power from an AC wall outlet into direct current (DC) power for use by the circuitry of device 10.

Figure 6:
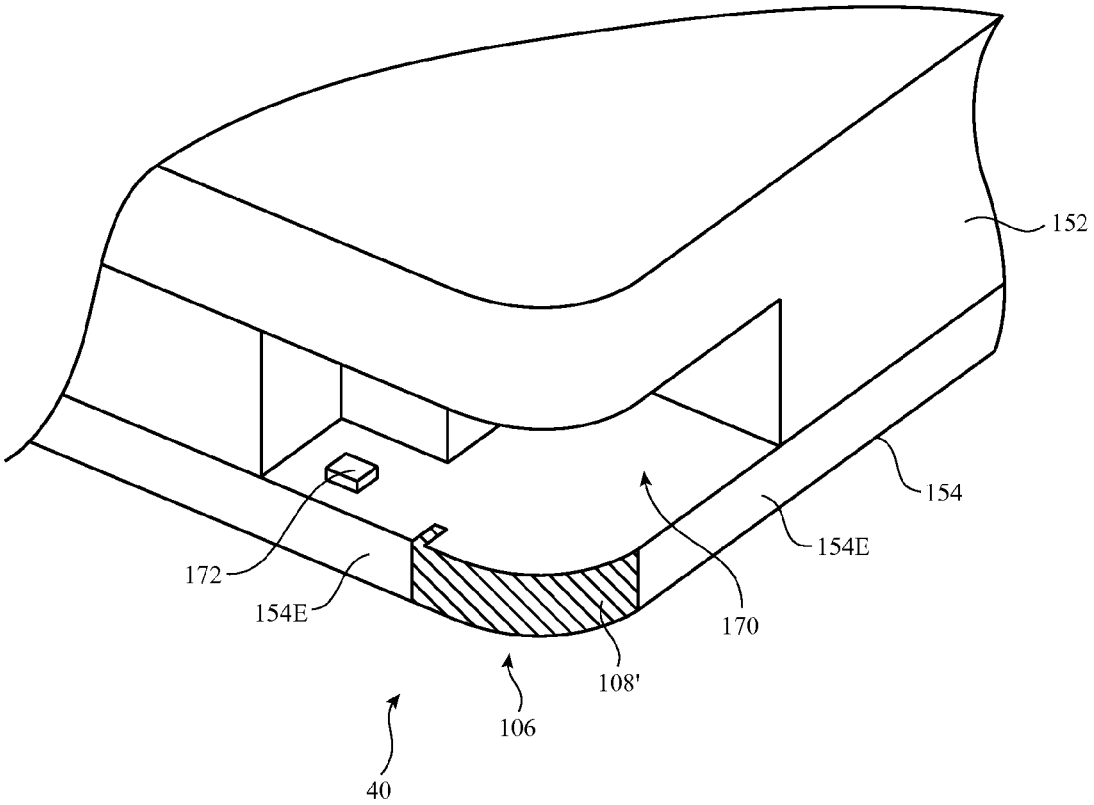
FIG. 6 is a perspective view of an illustrative interior portion of an electronic device with a cavity antenna in accordance with an embodiment.

Antennas for device 10 may be formed in the corners of housing 12, as described in connection with illustrative corners 14 and 16 of FIG. 1. A perspective view of a corner of device 10 (with outer housing 12 removed) is shown in FIG. 6. As shown in FIG. 6, antenna 40 may be formed from metal traces on printed circuit board 154 such as metal traces on edge 154E of printed circuit board 154 that form antenna resonating element arm 108'. An opening may be formed in the corner of heat spreader 152 to form cavity 170. The opening in heat spreader 152 may overlap portion of heat spreader 150, which may form a lower surface for cavity 170. The metal of device 10 such as the portions of heat spreader 152 (and heat spreader 150) that form the interior surfaces of cavity 170 may form antenna ground 104 (FIG. 4) for antenna 40. Cavity 170 may therefore form a cavity for antenna 40 (i.e., antenna 40 may be a cavity-backed inverted-F antenna). Cavity 170 may be shorted to ground traces on printed circuit 154 (e.g., ground traces that follow the inner wall of cavity 170). A gasket, conductive adhesive, solder, or other coupling mechanisms may be used to short the metal of heat spreader 152 associated with cavity 170 to the ground traces on printed circuit 154.

If desired, one or more electrical components such as electrical component 172 may be mounted within cavity 170. Component 172 may be an integrated circuit, sensor, or other circuitry for device 10 (see, e.g., circuitry 28 and 30 of FIG. 2). With one illustrative configuration, component 172 may be a light-emitting diode that control circuitry 28 turns on and off to convey status information to a user of device 10. Other electrical components may be mounted in antenna cavity 170 if desired. The incorporation of a light-emitting diode in cavity 170 is merely illustrative.

Figure 7:
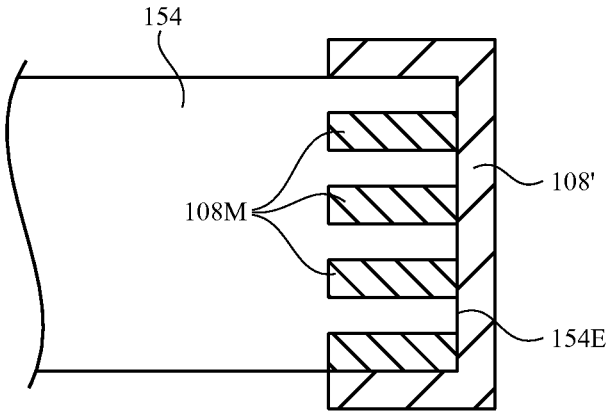
FIG. 7 is a cross-sectional side view of a portion of a printed circuit having an antenna resonating element formed from an edge plated metal trace in accordance with an embodiment.

Metal traces for antenna resonating element 106 may be formed on peripheral edge 154E of printed circuit 154 in order to maximize the separation between these metal traces and antenna ground 104 and thereby enhance antenna bandwidth. If desired, edge plating (electroless or electrolytic plating) techniques may be used to form metal traces for antenna 40 on the side of printed circuit 154. As shown in FIG. 7, metal layers such as metal layers 108M of printed circuit 154 may be coated with a plated metal layer along edge 154E using edge plating techniques, thereby forming an edge-plated metal structure such as antenna resonating element structure 108'. Because metal trace 108' of FIG. 7 is formed on edge 154E, trace 108' extends vertically, perpendicular to the plane of printed circuit 154. Other edge plated structures may be used in forming antenna 40, if desired.

Figure 8:
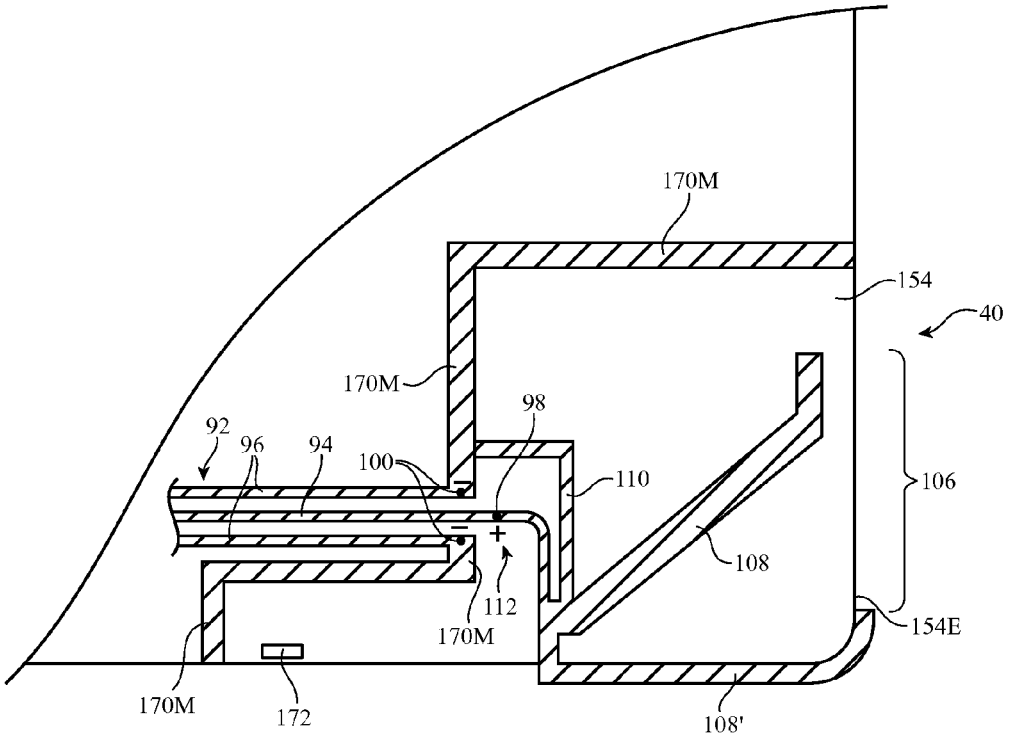
FIG. 8 is a top view of a corner portion of a printed circuit with an antenna resonating element in accordance with an embodiment.

FIG. 8 is a top view of a corner portion of printed circuit 154 (i.e., a view of the metal trace patterns on printed circuit 154 with the antenna cavity of heat spreader 152 removed). As shown in FIG. 8, ground traces 170M on printed circuit 154 may be aligned with the shape of the walls of cavity 170 (e.g., so that traces 170M are shorted along the walls of cavity 170 when heat spreader 152 is mounted above printed circuit 154 as shown in FIG. 6). Antenna signals may be routed to and from antenna 40 of FIG. 8 through a gap in ground traces 170M using transmission line 92. Transmission line 92 may include a central positive metal trace (line 94) flanked by a pair of ground metal traces (lines 96). At feed 112, trace 94 may be coupled to positive antenna feed terminal 98 and traces 96 may be coupled to ground antenna feed terminals 100.

Antenna resonating element 106 may have a longer arm such as arm 108 that lies within the middle of the area shadowed by cavity 170 and a shorter arm such as arm 108' that is formed from edge plated metal on edge 154E of printed circuit 154. Arm 108 may allow antenna 40 to resonate in a first communications band (e.g., at a frequency of 2.4 GHz) and arm 108' may allow antenna 40 to resonate in a second communications band (e.g., at a frequency of 5 GHz). Return path 110 may couple antenna resonating element 106 to ground. The higher frequency signals associated with arm 108' may be more directional in nature than the lower frequency signals associated with arm 108, so antenna performance may be enhanced by placing arm 108' at a location that is farther from the rear cavity wall of cavity 170 and ground traces 170M than arm 108.

Figure 9:
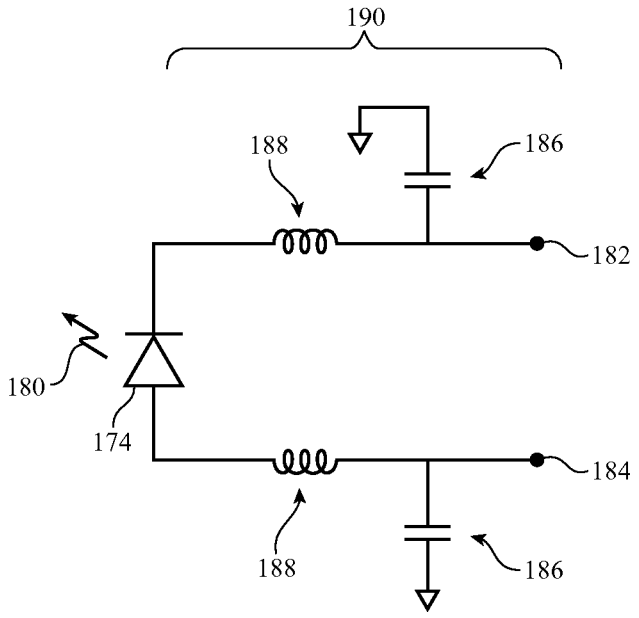
FIG. 9 is an illustrative isolation circuit of the type that may be used to prevent antenna signals from interfering with the operation of an electrical component such as a light-emitting diode in accordance with an embodiment.

Cavity 170 and associated ground traces 170M may have a shape that accommodates electrical component 172 (e.g., a light-emitting diode). To electrically isolate component 172 and antenna 40, device 10 may be provided with an isolation circuit of the type shown in FIG. 9. As shown in FIG. 9, light-emitting diode 172 may emit light 180 during operation. Control circuitry 28 (FIG. 1) may apply signals across terminals 182 and 184 to control the operation of diode 172 (i.e., to adjust the amount of light 180 that is emitted). Isolation circuitry such as isolation circuit 190 may be interposed between terminals 182 and 184 and diode 174 to isolate diode 174 from antenna 40. Isolation circuitry 190 may include shunt capacitors 186 and series inductors 188 or other isolation circuitry that blocks signals at radio frequencies.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a printed circuit board having a surface and a peripheral edge;

electrical components on the surface of the printed circuit board;

a heat spreader that dissipates heat from the electrical components; and an antenna having an antenna resonating element formed from a metal trace on the peripheral edge of the printed circuit board and an antenna cavity formed at least partly from the heat spreader.

2. The electronic device defined in claim 1 further comprising an electrical component in the antenna cavity.

3. The electronic device defined in claim 2 wherein the electrical component comprises a light-emitting diode.

4. The electronic device defined in claim 1 further comprising an antenna element that includes the antenna resonating element formed from the metal trace.

5. The electronic device defined in claim 4 wherein the metal trace comprises an edge-plated metal trace on the peripheral edge.

6. The electronic device defined in claim 5 wherein the antenna resonating element comprises an inverted-F antenna resonating element having first and second arms.

7. The electronic device defined in claim 6 wherein the first arm is longer than the second arm and the edge-plated metal trace forms the second arm.

8. The electronic device defined in claim 1 further comprising:

a light-emitting diode in the antenna cavity; and an isolation circuit coupled to the light-emitting diode.

9. The electronic device defined in claim 1 further comprising a plastic housing that covers the heat spreader and the printed circuit board.

10. The electronic device defined in claim 1 wherein the peripheral edge of the printed circuit board is substantially perpendicular to the surface of the printed circuit board.

11. An electronic device, comprising:

a housing;

a printed circuit board in the housing;

electrical components on the printed circuit board;

metal structures that dissipate heat from the electrical components; and an antenna formed from an antenna element and an antenna cavity, wherein the antenna element comprises an antenna resonating element formed from an edge plated metal trace on an edge of the printed circuit board and portions of the metal structures define the antenna cavity.

12. The electronic device defined in claim 11 wherein the antenna has an antenna feed, the electronic device further comprising a transmission line on the printed circuit board that is coupled to the antenna feed.

13. The electronic device defined in claim 12 further comprising an electrical component mounted on the printed circuit board in the antenna cavity.

14. The electronic device defined in claim 11 wherein the antenna element has a first arm that resonates at 2.4 GHz and a second arm that resonates at 5 GHz and the second arm includes the edge plated metal trace on the edge of the printed circuit board.

15. The electronic device defined in claim 11 wherein the metal structures are mounted on the surface of the printed circuit board.

16. An electronic device comprising:

a printed circuit board having circuitry, wherein the printed circuit board has first and second edges that define a corner of the printed circuit board;

a metal heat spreader that dissipates heat from the circuitry;

a dielectric housing having sidewalls and a top wall surrounding the metal heat spreader and the printed circuit board, wherein a portion of a corner of the metal heat spreader is removed to form at least part of an antenna cavity; and an antenna formed from the antenna cavity and from an antenna resonating element arm on the corner of the printed circuit board.

17. The electronic device defined in claim 16 further comprising a light-emitting diode in the antenna cavity.

18. The electronic device defined in claim 16 further comprising an additional antenna, wherein an additional portion of the metal heat spreader in another corner or the metal heat spreader is removed to form at least part of an additional antenna cavity, and wherein the additional antenna includes the additional antenna cavity and an additional antenna element on the printed circuit board.

19. The electronic device defined in claim 16 wherein the electronic device has a length, a width, and a height, the metal heat spreader extends substantially across the width of the electronic device, and the printed circuit extends substantially across the width of the electronic device.

* * * * *